United States Patent [19]

Holtermann et al.

[11] 4,216,347

[45] Aug. 5, 1980

[54] VACUUM-ELECTRIC ARC HEATING SYSTEM

[75] Inventors: Heinz Holtermann, Meerbusch; Arno Luven, Krefeld-Bockum, both of Fed. Rep. of Germany

[73] Assignee: Standard-Messo-Duisburg Gesellschaft für Chemietechnik mit beschränkter Haftung & Co., Duisburg, Fed. Rep. of Germany

[21] Appl. No.: 433,906

[22] Filed: Jan. 16, 1974

[51] Int. Cl.[2] ..... H05B 7/00

[52] U.S. Cl. ..... 13/9 R; 13/13; 13/16; 13/31 R

[58] Field of Search ..... 13/14, 15, 16, 17, 18 C, 13/31, 13

[56] References Cited

U.S. PATENT DOCUMENTS

| | | | |
|---|---|---|---|
| 2,343,443 | 3/1944 | Brooke | 13/18 C |
| 2,973,452 | 2/1961 | Garmy | 13/31 |
| 3,240,856 | 3/1966 | Wynne | 13/14 |
| 3,665,084 | 5/1972 | Samietz et al. | 13/31 |

*Primary Examiner*—Roy N. Envall, Jr.
*Attorney, Agent, or Firm*—Becker & Becker, Inc.

[57] ABSTRACT an electric arc heating system for use with a vacuum metallurgic unit, which includes at least one graphite electrode that is composed of two or more interconnected graphite electrode sections and is adapted selectively to be lifted and lowered by lifting and lowering means from which it can easily be disconnected, while the electrode or electrodes is or are surrounded by a tubular mantle and the latter is surrounded by jacket means in a vacuum-tight manner which jacket means has that end thereof which is remote from the metallurgic unit provided with closure means for tightly closing an opening at the last mentioned end.

8 Claims, 1 Drawing Figure

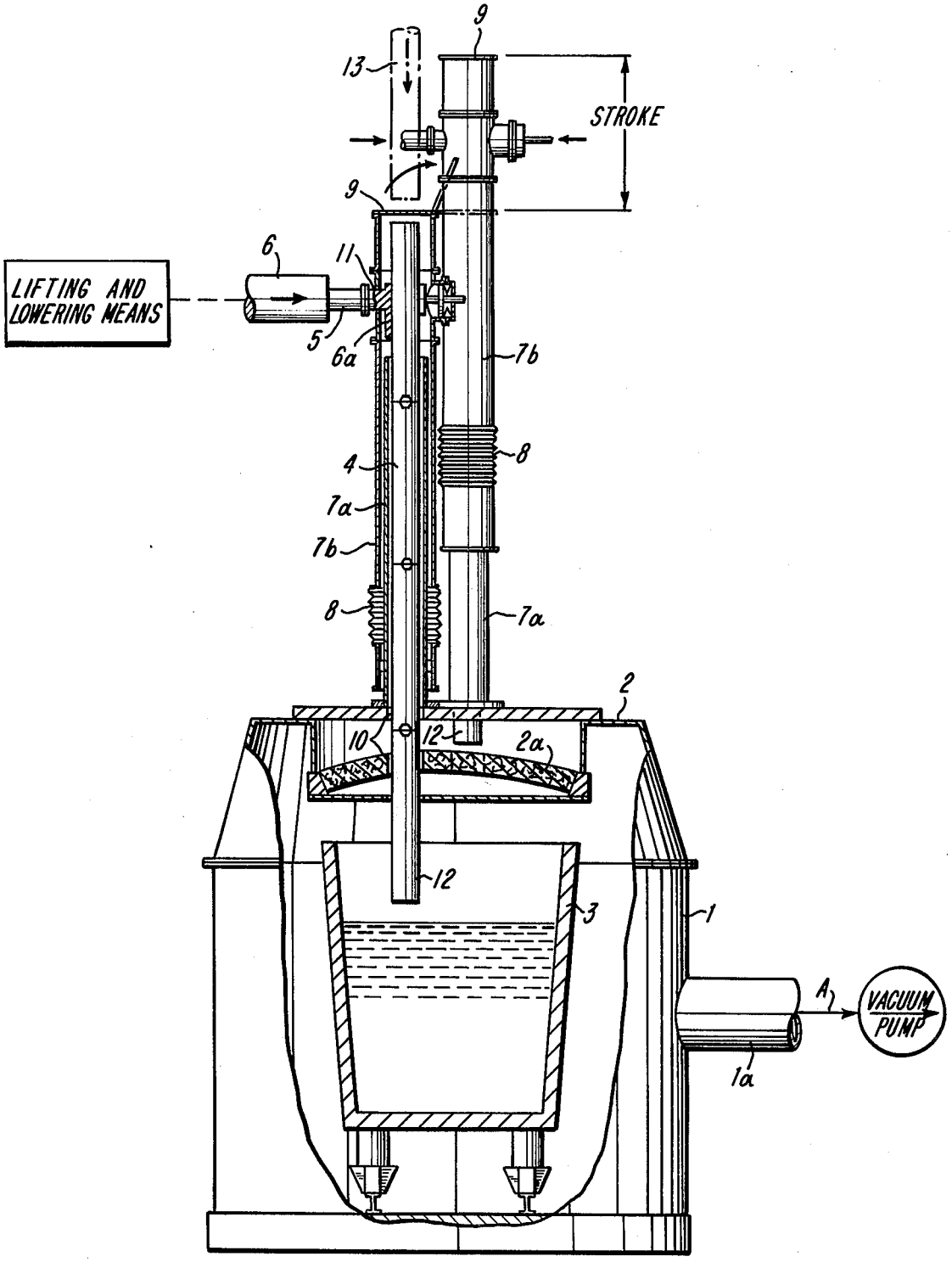
9
13
STROKE
9
6
11
LIFTING AND LOWERING MEANS
5
6a
7b
8
4
7a
7b
8
7a
2
10
12
2a
12
3
1
A
VACUUM PUMP
1a

VACUUM-ELECTRIC ARC HEATING SYSTEM

The present invention relates to an electric arc heating system of a metallurgical vessel which is adapted to be closed in a vacuum tight manner by a removable cover and which is intended primarily for melting and/or treating metals, especially steel, in a vacuum with at least one electrode that is adapted to be lifted and lowered and is connected to a lifting device, said electrode being sealed relative to the interior of the vacuum vessel by means of a tubular mantle associated with a passage for the electrode, which passage is provided in the cover, and by means of a vacuum seal.

An electric arc heating system of the above mentioned general type is known in connection with vacuum metallurgical ladle degasification. A device for ladle degasifications of melts is usually built up and consists of a vacuum vessel in the form of a large cylindrical chamber which is adapted to be closed in a vacuum tight manner by a cover. With the ladle degasification, the top ladle filled with a melt is lowered into the vacuum vessel which later is then closed by the cover. At the bottom side of the cover there is provided as a rule a radial protective means of sheet metal or refractory ramming mixture or mass which is held on the cover by ribs. On the cover there are provided feeding devices and observation windows.

After the tap ladle has been inserted, a vacuum is generated in the vacuum vessel and starts the desired degasification process.

It has proved expedient to compensate the heat losses by an auxiliary heating system. To this end, the vacuum arc heating system has been developed. According to this heating system at least one electrode is connected to a supporting arm on the lifting device, which lifting arm is adapted to be lifted and lowered. The electrode extends through an opening in the cover of the vacuum vessel into the latter. The electrode consists of a copper electrode rod and a graphite electrode rod screwed onto the copper electrode rod while the copper electrode rod is fixedly connected to the lifting device. At this connection, also the current supply is effected.

In order to prevent a reduction in the vacuum air the electrode passes through the cover into the vacuum vessel, a tubular jacket is connected to the cover which tubular jacket is sealed relative to the copper electrode jaws by means of a stuffing box which is fixedly connected to the tubular jacket. The passage of the electrode through the cover is in this way effected in a vacuum tight manner. In this connection, however, it is disadvantageous that after the graphite electrode has burned off, an exchange of the electrode must be effected which can be carried out only from below because the electrode in its entirety cannot be withdrawn in upward direction. Therefore, first the cover of the vacuum vessel is to be removed whereupon the operator has to wait until the cover or the radiation protective device has cooled sufficiently to permit a working on the electrode. After a correspondingly long cooling period, the graphite electrode is then unscrewed from the copper electrode rod and is replaced.

It is, therefore, an object of the present invention to provide an arrangement which will make it possible to replace the comsumed portion of the graphite electrode independently of the removal of the cover of the vacuum vessel, in other words which will make it possible to replace the comsumed portion of the graphite electrode from above while avoiding an electrode exchange.

It is another object of this invention to bring about that the consumption of the electrode and the thereby necessary replacement of the consumed electrode portion will no longer require an interruption of the respective operation nor require any waiting periods.

These and other objects and advantages of the invention will appear more clearly from the following specification in connection with the accompanying drawing illustrating a preferred embodiment of an electric arc heating system according to the invention and diagrammatically shows a ladle degasifying device with electric arc heating system.

The problem underlying the present invention has been solved according to the invention by composing the electrode in its entirety of individual graphite elements which are directly connected to the current supply, the connection of the graphite electrode to the lifting device for the electrode being easily disengageable. The arrangement according to the invention is furthermore characterized in that the tubular mantle and the graphite electrode are surrounded by a jacket in a vacuum tight manner which jacket is at that end that is remote from the vacuum vessel provided with an opening which can selectively be sealed. In this way it can be assured that no longer an electrode exchange will be necessary. Rather by a simple piecing of graphite elements outside said vacuum vessel to the graphite electrode it is necessary only very briefly to interrupt the heating operation. Due to the easily disconnectable connection of the graphite electrode to the lifting device and due to the opening in the jacket, it is made possible easily to pull up the graphite electrode and to piece onto the latter a new non-consuming graphite element. Nevertheless this device for electric arc heating is in a customary manner adapted to be lifted and lowered in a vacuum tight manner relative to the interior of the vacuum vessel.

According to a particularly advantageous design of the invention, a vacuum seal preferably a stuffing box is arranged between the jacket and the tubular mantle. As a result thereof, the lifting movement will be simplified while the seal will by the degree of sealing be retained. The tubular mantle which extends from the cover by at least the lifting height of the electric arc heating device plus the height of the stuffing box may be extended or elongated for purposes of improving the guidance of the graphite electrode in its movement up to the lifting device.

It is advantageous so to design the opening in the jacket that it can be closed by a flat or foldable cover so that by a simple folding back action the access to the graphite electrode will be opened.

During the operation of the device, the necessary lowering and lifting movement might bring about jamming which in conformity with the further development of the invention can be compensated for by a compensator on the jacket.

The lifting device which through the jacket directly engages the graphite electrode is expediently provided with a detachable clamping device. This clamping device consists of two cooperating clamping jaws which in closing position are spring loaded. These clamping jaws are adapted to be hydraulically operated against the spring force so as to be brought into opening position. In this way an easy disengagement of the otherwise firm connection and an adjustment of the graphite electrode after extension by piecing on a new graphite element will be possible.

Referring now to the drawing in detail, the device illustrated therein for ladle degasification comprises a vacuum vessel 1, which is closed in a vacuum tight manner by a cover 2 of the vessel. Connected to the cover 2 of the vessel is a radiation protective device 2*a* of a type known per se, said device 2*a* together with the cover 2 being adapted to be lifted off the vacuum vessel 1. In the interior of the vacuum vessel, there is arranged a ladle 3 which is filled with liquid steel. By means of the connection 1*a* to the vacuum vessel 1 and by an arrow A it is indicated in this drawing that an underpressure in the vacuum vessel may be generated by a pump or the like.

This device for ladle degasification is adapted to be heated by means of an electric arc heating system. To this end, three coaxially arranged graphite electrodes 4 (two only being shown) are provided which are composed of individual sections and extend into the interior of the vacuum vessel 1 through the cover 2 of the vessel. The graphite electrodes 4 are through a spring loaded jaw 6*a* connected directly to a supporting arm included with the lifting device 6 which arm is adapted to be lifted and lowered. At the connecting area there is effected the supply of current 5 to the electrode 4. The drawing shows an electrode 4 in section lowered into the vacuum vessel 1 to its lowermost lifting position. The drawing furthermore illustrates a view of an electrode 4 occupying its uppermost lifting position whereby the function of the device will be made clearer.

At each passage 10 in the vessel cover 2 and the radiation protective device 2*a* for each electrode 4 there is provided a tubular mantle 7*a* which surrounds the electrode 4. The mantle 7*a* is connected to the cover 2 in a vacuum tight manner and for improving the guidance of the graphite electrode 4 in its lifting movement it is pulled upwardly to the spring loaded clamping jaw 6*a* included with the lifting device 6. The tubular mantle 7*a* is surrounded in the form of a jacket 7*b* in the form of an outer mantle which extends around the entire graphite electrode 4 above the cover 2. The jacket 7*b* is provided with openings 11 for passing through the spring loaded clamping jaws 6*a* in a vacuum tight manner, and thus these openings are designed for connecting the electrode 4 to the current supply 5 and the lifting device 6. The upper end of the jacket 7*b* is provided with a closure 9 for the cover, the drawing also shows the cover in the folded up position. The closure 9 is designed so as to be vacuum tight. Moreover, the jacket 7*b* is provided with a compensator 8 at its lower end.

Between the mantle 7*a* and the outer mantle or jacket there is provided a sealing cylinder or stuffing box 7*c* which is connected to the jacket 7*b* and surrounds the mantle 7*a* in a tight manner. The jacket 7*b* and the cylinder 7*c* are together only so long that the lifting movement of the lifting device can be freely effected and that also in the lowermost position no upsetting upon the vessel cover 2 can be effected.

In operation, with the electric arc heating system according to the invention, it will be appreciated that after the graphite element 12 in the vacuum vessel 1 has been consumed, a new graphite element 13 is at the top connected to the graphite electrode 4*b* for instance by a screw connection. To this end, the lifting device or hydraulically operable means 6 is moved to its uppermost position, and the cover closure 9 is opened. Thereupon, with the hydraulically operable means selectively effective, the spring loaded clamping jaws 6*a* are opened up so that the adjustment of the electrode 4 to its position of operation can be effected. Thereupon the clamping jaws 6*a* and the cover closure 9 are again closed and the heating device is again ready for operation.

It is, of course, to be understood that the present invention is, by no means, limited to the specific showing in the drawing but also comprises any modifications within the scope of the appended claims. It may furthermore be noted that the electric arc heating devices according to the invention can also be used on different vacuum metallurgical units such as melting furnaces.

What we claim is:

1. An electric arc heating system for use in connection with a vacuum metallurgic unit comprising a vessel and a cover thereon having passage means for the passage of at least one electrode therethrough, which includes: at least one electrode composed of a plurality of interconnected graphite sections, current supply means connected directly to said electrode, lifting and lowering means detachably connected to said electrode for lifting and lowering the same, tubular mantle means surrounding said electrode and adapted to be connected to said cover at said passage means in a vacuum-tight manner, and jacket means surrounding both said electrode and the tubular mantle means therefor in a vacuum-tight manner and being movable upwardly and downwardly together with said electrode and relative to said tubular mantle means, said jacket means including cover means arranged at that end of said jacket means which in mounted position of said heating system will be remote from the vacuum metallurgic unit for which said electric arc heating system is intended, said jacket means being adapted selectively to be opened with vacuum being broken to afford access to the electrode for replacement of graphite sections within said jacket, and said cover means being adapted to be closed again in a vacuum-tight manner.

2. An electric arc heating system according to claim 1, which includes a vacuum seal arranged between said tubular mantle means and said electrode.

3. An electric arc heating system according to claim 2, in which said vacuum seal is located near that end portion of said jacket means which is remote from said cover means.

4. An electric arc heating system according to claim 2, in which a stuffing box is included with said seal.

5. An electric arc heating system according to claim 1, in which a flap is included with said cover means.

6. An electric arc heating system according to claim 1, which includes a compensator associated with said jacket means for compensating for a longitudinal expansion of said jacket means.

7. An electric arc heating system according to claim 1, in which said tubular mantle means extends up to said lifting and lowering means.

8. An electric arc heating system according to claim 1, which includes spring loaded clamping means associated with said lifting and lowering means, and hydraulically operable means associated with said clamping means and operable selectively to move said clamping means to its opening position.

* * * * *